US006629705B1

(12) United States Patent
Ellis

(10) Patent No.: US 6,629,705 B1
(45) Date of Patent: Oct. 7, 2003

(54) MAGAZINE INSERT AND METHOD FOR MAKING SAME

(76) Inventor: Gary R. Ellis, 7461 Mullins Cove, Whitwell, TN (US) 37397

( * ) Notice: Subject to any disclaimer, the term of this patent is extended or adjusted under 35 U.S.C. 154(b) by 8 days.

(21) Appl. No.: 09/885,612

(22) Filed: Jun. 20, 2001

(51) Int. Cl.[7] ..... B42D 15/00

(52) U.S. Cl. ..... 283/56; 283/61; 283/116; 206/581; 428/905

(58) Field of Search ..... 283/67, 70, 56, 283/116, 117, 61, 62; 287/38; 206/527, 204, 205, 581; 428/905

(56) References Cited

U.S. PATENT DOCUMENTS

| | | | | |
|---|---|---|---|---|
| 460,472 A | | 9/1891 | Hitt | |
| 3,116,077 A | | 12/1963 | Bird | |
| 4,011,985 A | * | 3/1977 | Simson | 283/56 |
| 4,084,696 A | | 4/1978 | Katz | |
| 5,050,910 A | | 9/1991 | Schechter et al. | |
| 5,188,236 A | | 2/1993 | Sayers et al. | |
| 5,248,537 A | | 9/1993 | Giannavola | |
| 5,813,596 A | | 9/1998 | Dahlquist | |
| 5,918,908 A | | 7/1999 | Barnett et al. | |
| 5,928,748 A | | 7/1999 | Jones et al. | |
| 5,967,557 A | | 10/1999 | Dahlquist | |
| 5,992,889 A | | 11/1999 | Barnett et al. | |
| 6,036,806 A | | 3/2000 | Dahlquist | |

* cited by examiner

*Primary Examiner*—Willmon Fridie, Jr.
(74) *Attorney, Agent, or Firm*—Chambliss, Bahner & Stophel, P.C.

(57) ABSTRACT

An advertising page that is intended to be bound within a publication includes a page portion and an extension portion. The publication is bound along a binding side, and the page portion of the advertising page has a binding side and a plurality of unbound sides. The extension portion of the advertising page is contiguous with a part of an unbound side of the page portion that is adjacent to the binding side and has an inner side that is spaced from the binding side of the page portion. At least a part of the extension portion is folded over to form a folded part. In a preferred embodiment of the invention, a sample material is contained within the folded part of the extension portion. The invention also includes a method for making an advertising page.

18 Claims, 4 Drawing Sheets

MAGAZINE INSERT AND METHOD FOR MAKING SAME

FIELD OF THE INVENTION

This invention relates generally to an advertising page which is bound within a publication comprised of a plurality of pages bound together along a binding side. The advertising page may enclose a product sample or include a detachable coupon or information card.

BACKGROUND AND DESCRIPTION OF THE PRIOR ART

Manufacturers commonly advertise their products in magazines and other publications. Most of such advertisements are printed on pages which are bound within the publication. Sometimes such advertisements, especially those for fragrances, cosmetics and personal care or medical products, include small samples of the products that are enclosed or encapsulated between panels or flaps of paper that are attached to the advertising page. It is common for such samples to be enclosed by a panel of the advertising page that is folded over the sample material on the side of the page opposite the binding. These samples may be provided as pure product in powder, liquid, gel or other form, or as a product which is microencapsulated and contained in a matrix material containing a releasable adhesive. When provided in pure product form, the covering panel is usually attached to the page around the area occupied by the sample, using a releasable adhesive, so that the panel may be lifted or opened to expose the sample. When provided in the form of a product which is microencapsulated, the adhesive in the matrix material typically serves to attach the microencapsulated of the sample to each other and to the opposing layers of the folded panel, so that when the panel is lifted or opened, the microcapsules are ruptured, thereby releasing or exposing the sample.

Advertising pages which include a sample material that is enclosed by a folded panel of the page or which include a folded panel comprising or enclosing a coupon or information card are usually made from a sheet or piece of paper that is wider than the other pages of the publication. In the case of an advertising page enclosing a sample of a fragrance or other product, the sample is usually placed near the outside edge of the page (opposite the side to be bound within the publication), and a portion or panel of the page is folded over the sample so as to create a finished advertising page that is narrower than the remaining pages of the publication. In the case of an advertising page which includes a folded panel comprising or enclosing a coupon or information card, the panel is also folded so as to create a finished page that is narrower than the remaining pages of the publication. Advertising pages which include folded panels are usually prepared in this way because of the way that the publications are bound. A magazine or other publication is typically assembled from untrimmed pages that extend beyond the length and width of the finished size. These pages are bound along one side, and the excess on the top, bottom and side of the pages opposite the binding side is then cut off to finish the publication. If the advertiser's sample or other folded panel was placed so that the finished edge of the advertising page was aligned with all the other pages in the publication, the sample enclosure could be breached or the fold of the panel cut off during the trimming operation. If the sample is microencapsulated, breach of the sample enclosure will most likely result in loss of at least a portion of the sample, and will leave the panel attached to the advertising page only by the releasable adhesive. Such adhesively attached sample-enclosing panel could be disengaged prior to delivery of the publication to its purchaser, thereby releasing or exposing the sample prematurely. Furthermore, cutting the fold of any conventional folded panel other than an adhesively-attached sample-enclosing panel during binding will prematurely detach the panel from the page.

One disadvantage of the conventional method for providing an advertising page that is suitable for containing a sample material (or which includes another folded panel) is the limitation that because of the method of construction, only one folded panel may be provided for a page, although the single folded panel may be cut or perforated into a plurality of panels having a common fold line. Another disadvantage of the conventional method for providing an advertising page having a folded panel is a reduction in the portion of the consumer's field of vision occupied by the advertisement when the consumer looks at the page, due to the fact that the reduced-size advertising insert is bordered on the outside edge (the edge opposite the binding side) by the magazine text or other advertisement that appears on a subsequent page. In order to overcome this disadvantage, U.S. Pat. No. 5,918,908 and U.S. Pat. No. 5,992,889, both of Barnett et al., describe an advertising page for a magazine which includes a fragrance-releasing portion that is offset from the outside edge of the page so that the page that may be trimmed along its outside edge to match the size of all of the other pages of the publication. Because of the location of the fragrance-releasing portion, it will not be breached or damaged when the pages of the magazine are trimmed in the publication process; however the panel enclosing the fragrance sample is provided separately from or cut from the remainder of the advertising page, leaving it attached to the advertising page only by an adhesive. In recognition of this disadvantage, at least one embodiment of the Barnett invention contemplates a use of two types of adhesives, including a releasable adhesive to permit removal of a portion of a panel covering a sample, and a permanent adhesive to provide for permanent attachment of a portion of the panel to the reminder of the advertising page.

It would be desirable if an advertising page could be provided with a folded panel for containing a sample, or for containing or comprising a coupon or other insert, which page could be trimmed along the side opposite its binding side without cutting or sacrificing the fold of the panel. It would also be desirable if such an advertising page could be provided which could be formed from a sheet that is narrower than that employed to create a conventional advertising page which includes a panel that is folded so that the finished page is narrower than the other pages of the publication. It would also be desirable if such an advertising page could be provided which includes two folded panels that do not require a separate finishing operation such as cutting or perforating a folded panel into a plurality of panels.

ADVANTAGES OF THE INVENTION

Among the advantages of the invention is that it provides an advertising page with a folded panel for containing a sample, or for containing or comprising a coupon or other insert, which page can be trimmed along the side opposite its binding side without cutting or sacrificing the fold of the panel. Another advantage of the invention is that such an advertising page may be provided which can be formed from a sheet that is narrower than that employed to create a conventional advertising page. Still another advantage of the invention is the provision of an advertising page which may include two folded panels that do not require a separate finishing operation such as cutting or perforating a previously folded panel into a plurality of panels. Yet another advantage of the invention is the provision of a versatile advertising page that provides a smaller folded panel that requires less paper to produce than a conventional advertising page having a folded panel. Another advantage of the invention is the provision of an advertising page having a folded panel that requires less ink to print than the folded panel of a conventional advertising page.

Additional advantages of this invention will become apparent from an examination of the drawings and the ensuing description.

Explanation of Technical Terms

As used herein, the term advertising page refers to a page, leaf or insert which is bound within a publication comprised of a plurality of pages bound together along a binding side. The advertising page is used to advertise a product or service, and may enclose a product sample or include a detachable coupon or information card.

As used herein, the term binding side of a publication refers to the side of the publication which is bound or intended to be bound together or to a common binding material by using staples, glue or other binding means. The binding side of a page of a publication is the side of the page which is bound or intended to be bound with the binding side of the other pages of the publication.

As used herein, the term publication refers to a book, magazine or other periodical, or any collection of pages that are bound or attached together, or intended to be bound or attached together, or to a common binding material along a binding side. A publication may or may not include a cover.

As used herein, the term binding material refers to a cover or a component of the cover of a publication to which the pages may be bound.

As used herein, the terms sample and sample material refer to a quantity of a fragrance, cosmetic, personal care product, medical treatment or other product that may be enclosed or encapsulated in or on an advertising page of a publication.

SUMMARY OF THE INVENTION

The invention comprises an advertising page which is bound within a publication comprised of a plurality of pages bound together along a binding side, which advertising page comprises a page portion and an extension portion. The page portion has a binding side and a plurality of unbound sides. The extension portion is contiguous with a part of an unbound side of the page portion that is adjacent to the binding side, and has an inner side that is spaced from the binding side of the page portion. At least a part of the extension portion is folded over to form a folded part. In a preferred embodiment of the invention, a sample material is contained within the folded part. The invention also includes a method for making an advertising page that may be bound within a publication.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
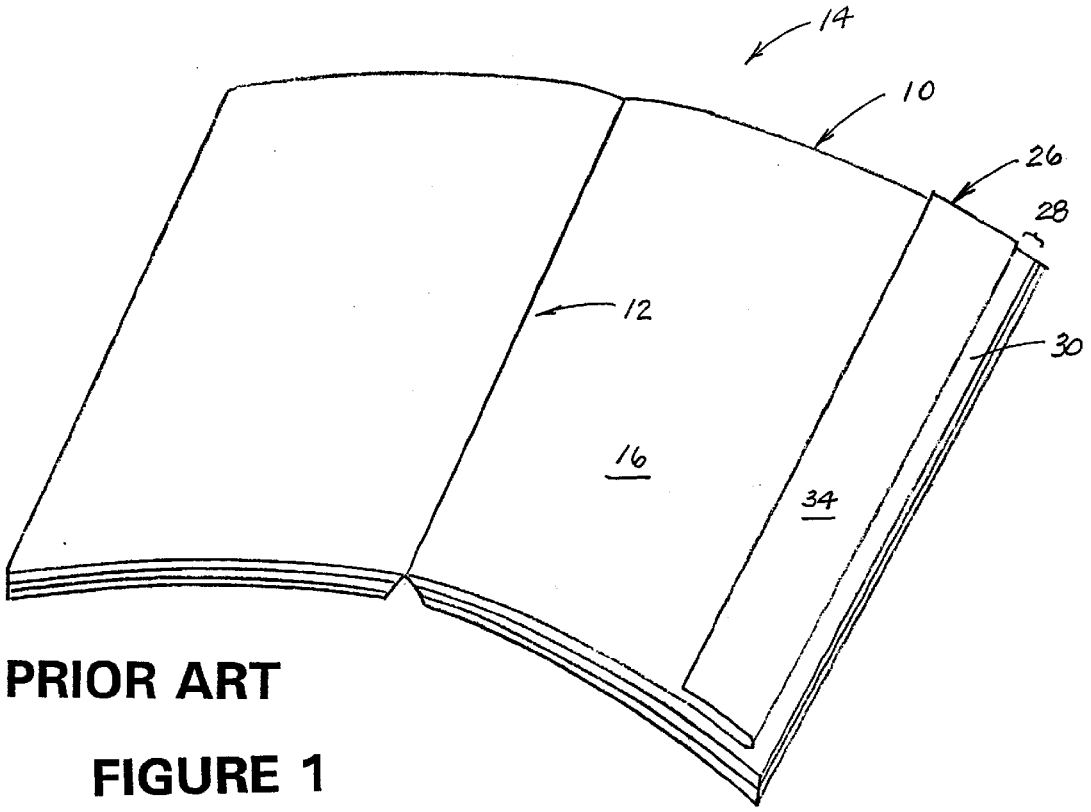
PRIOR ART FIGURE 1
FIG. 1 is a perspective view of an advertising page of the prior art, shown bound in a publication.
Figure 2:
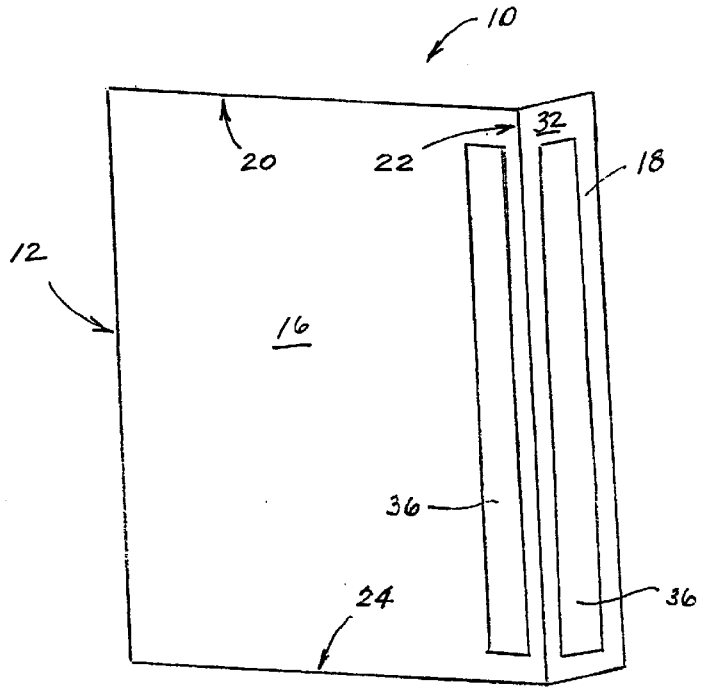
PRIOR ART FIGURE 2
FIG. 2 is a perspective view of the advertising page of FIG. 1, revealing a sample material contained therein.

Referring now to the drawings, FIGS. 1 and 2 illustrate advertising pages of the conventional type, such as page 10, which is bound along binding side 12 with a plurality of other pages to form publication 14. Advertising page 10 includes page portion 16 and extension portion 18. Page portion 16 includes, in addition to binding side 12, unbound sides 20, 22 and 24. Extension portion 18 is contiguous with unbound side 22 of page portion 16 and is disposed directly opposite binding side 12. Extension portion 18 is folded over the page portion to form a folded part 26, resulting in a finished advertising page which is narrower than the remaining pages of the publication. Thus, as shown in FIG. 1, outer edge 28 of following page 30 is exposed to view when the publication is opened to advertising page 10.

Folded part 26 of extension portion 18 includes an inner surface 32 (see FIG. 2) and an outer surface 34 (see FIG. 1). A sample is contained within the folded part of page 10, such as microencapsulated fragrance sample 36, a portion of which is exposed on inner surface 32 of extension portion 18 and a portion of which is exposed on page portion 16.

Figure 3:
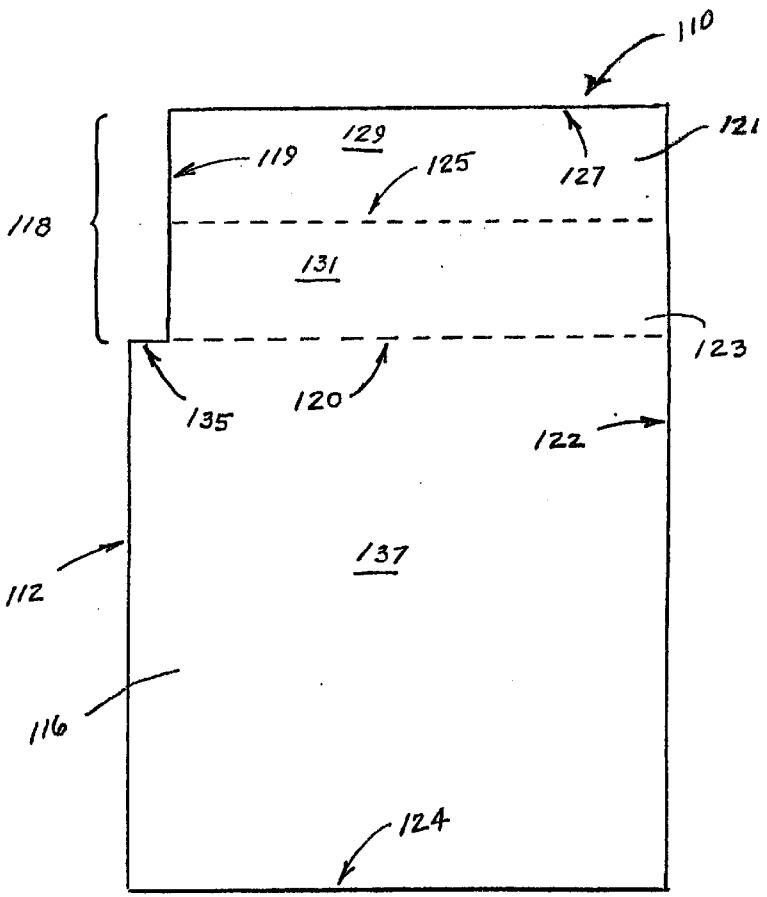
FIG. 3 is a plan view of a preferred embodiment of an advertising page of the invention, prior to folding and prior to application of a sample material.
Figure 4:
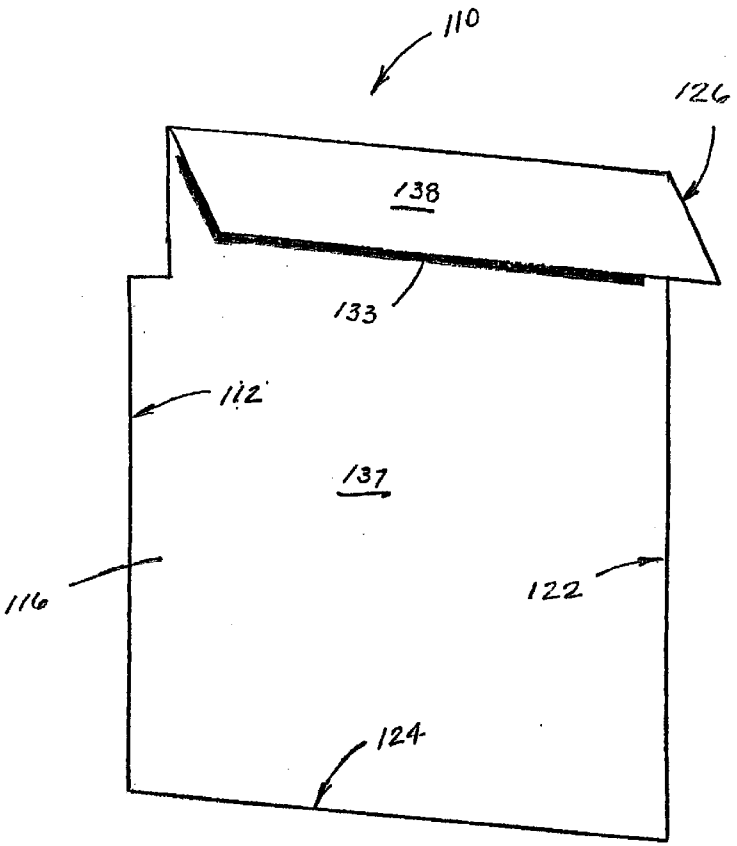
FIG. 4 is a perspective view of the advertising page of FIG. 3, when provided with a sample material and folded according to a first embodiment of the invention.

The preferred embodiments of the improved advertising page of the invention are illustrated in FIGS. 3 through 8. As shown in FIG. 3, preferred advertising page 110 includes generally rectangular page portion 116, which has binding side 112, a top unbound side defined by line 120, outer unbound side 122 and bottom unbound side 124. Both the top unbound side and the bottom unbound side of page portion 116 are adjacent to binding side 112, which is adapted to be bound with or into the pages of a publication (not shown). Page 110 also includes extension portion 118 which is contiguous with a part of the top unbound side of the page portion and which has inner side 119 that is spaced from (or offset from) binding side 112 of the page portion. The extension portion also includes first part 121 and second part 123 which are divided by line 125 into parts of generally equal size, although the line of division between the first part and the second part may be placed at any convenient location. First part 121 is folded over second part 123 to form a folded part 126, as shown in FIG. 4. In the alternative, at least a part of extension portion 118 may be folded over along line 120 or along any line located between line 120 and top side 127. If a part of extension portion 118 is folded over along line 120 or along any line located between line 120 and line 125, the folded part will overlap a part of page portion 116.

Surface 129 of first part 121 and/or surface 131 of second part 123 may be printed with a coupon, information card or other advertisement. Lines 120 and/or 125 may also be perforated to permit removal of such coupon or information card. The inner surface of folded part 126, comprised of surfaces 129 and 131, may be printed with an advertisement that continues onto surface 137 of page portion 116. In addition (or in the alternative), surface 138 of folded part 126 may be printed with an advertisement that continues onto surface 137 of page portion 116.

One or more sample materials, such as sample 133 (see FIG. 4) may also be applied to either or both of surfaces 129 and 131 or contained between such surfaces by any means known to those having ordinary skill in the art to which the invention relates or which may be subsequently developed. If more than one sample material is applied (not shown), the sample materials will preferably be applied in discrete regions of the surfaces which are separated by perforations (also not shown) which are perpendicular to line 120 of FIG. 3.

Preferably, folded part 126 will be attached to surface 131 of the extension portion by an adhesive. Such adhesive may be releaseable, and if so, it is preferred that the adhesive surround, be contained within, or overlie sample 133. If an adhesive that is not releaseable is employed, it is preferred that the adhesive be applied to limited sites between surfaces 129 and 131 outside of the area occupied by any sample. It is also contemplated by and within the scope of the invention that the extension portion may be folded over, and attached to, a portion of the page portion, such as for example, if it is folded at line 120 or any line between 120 and 125.

Figure 5:
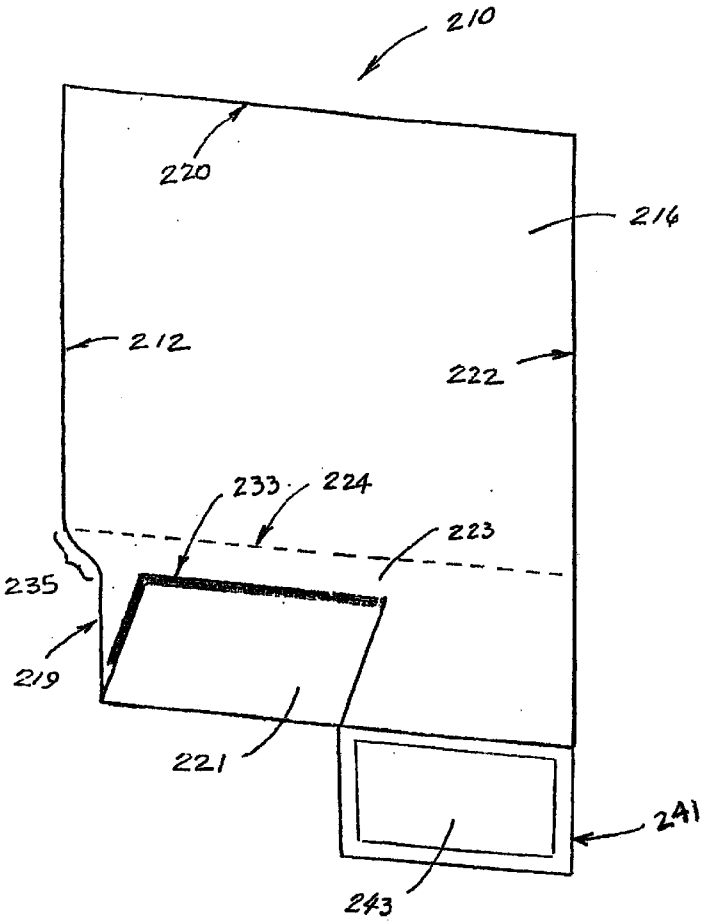
FIG. 5 is a perspective view of an advertising page similar to that of FIG. 3, when folded according to a second embodiment of the invention.

As shown in FIGS. 3 and 4, extension portion 118 has inner side 119 that is spaced from (or offset from) binding side 112 of the page portion. Because of this spacing, the top unbound side of page portion 116, which is generally defined by line 120, is also defined in part by line 135. It may be desirable that the top unbound side be defined in part by a line that is not straight (as is line 135). FIG. 5 illustrates an embodiment of the invention in which an unbound side of the page portion is defined in part by curved line 235. FIG. 5 also illustrates an embodiment of the invention in which a pair of samples may be provided. As shown in FIG. 5, advertising page 210 includes page portion 216, which has binding side 212, top unbound side 220, outer unbound side 222 and a bottom unbound side defined by line 224. Both the top unbound side and the bottom unbound side of page portion 216 are adjacent to binding side 212, which is adapted to be bound with or into the pages of a publication (not shown). Page 210 also includes an extension portion which is contiguous with a part of the bottom unbound side of the page portion and which has inner side 219 that is spaced from (or offset from) binding side 212 of the page portion. The extension portion also includes a first part which is perforated so as to be separable (as illustrated in FIG. 5) into left portion 221 and right portion 241. These portions 221 and 241 are folded over second part 223 to form a pair of folded parts which contain sample materials 233 and 243. Although the sample materials are illustrated in FIG. 5 as being applied to the inside surfaces of portions 221 and 241, they may also be applied to second part 223 beneath the left and right portions. Although not shown in the drawings, it may be desirable, in some circumstances, to apply sample materials to both the inside surfaces of portions 221 and 241 and to the corresponding surfaces of second part 223. It may also be desirable, although not shown in the drawings, to eliminate the sample materials from the advertising page of FIG. 5 and print a pair of coupons onto left and right portions 221 and 241.

According to a preferred embodiment of the invention, the advertising page may be provided in the form of page 110 shown in FIG. 3. In such event, the page may be folded as described herein to further prepare the advertising page for binding in a publication. In the alternative, however, the advertising page may be provided in the form of a generally rectangular sheet having a binding side, and a portion of the sheet may be folded along a fold that is generally perpendicular to the binding side to form a folded part having an area less than one half of the area of the rectangular sheet. Then a notch may be cut along a side of the folded part adjacent to the binding side of the sheet and sample material added (if desired) to create an advertising page such as is shown in either FIG. 4 or FIG. 5. The order in which these steps are carried out is not critical. For example, the invention may also be practiced by first applying a sample material to a portion of the sheet, and then folding the sheet along a fold that is generally perpendicular to the binding side to form a folded part which includes the sample material and which has an area less than one half of the area of the rectangular sheet. Finally, a notch may be cut along a side of the folded part adjacent to the binding side of the sheet to create an advertising page such as is shown in either FIG. 4 or FIG. 5.

Figure 6:
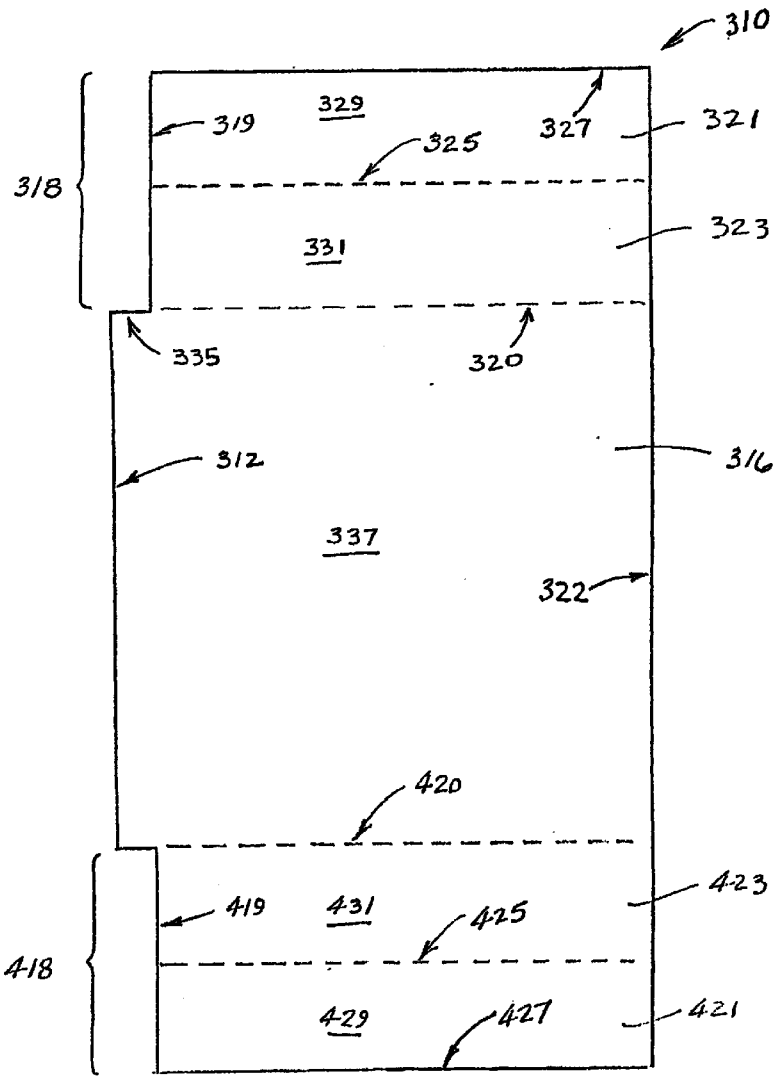
FIG. 6 is a plan view of an alternative embodiment of an advertising page of the invention, prior to folding and prior to application of sample materials.
Figure 8:
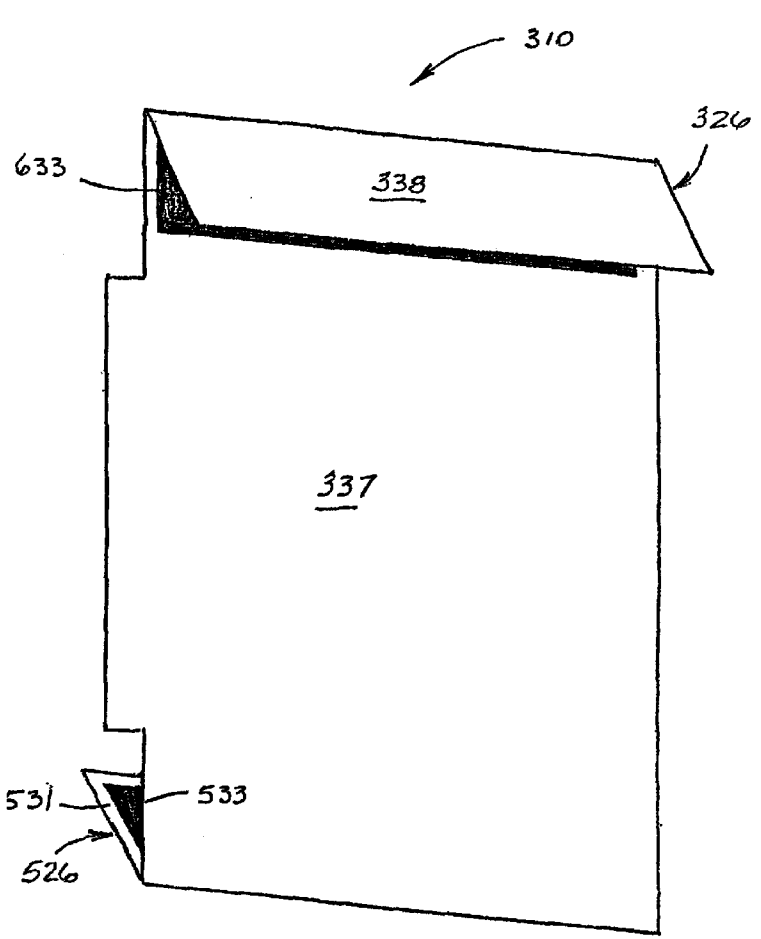
FIG. 8 is a perspective view of the advertising page of FIG. 6, when provided with two sample materials and folded according to a fourth embodiment of the invention.
Figure 7:
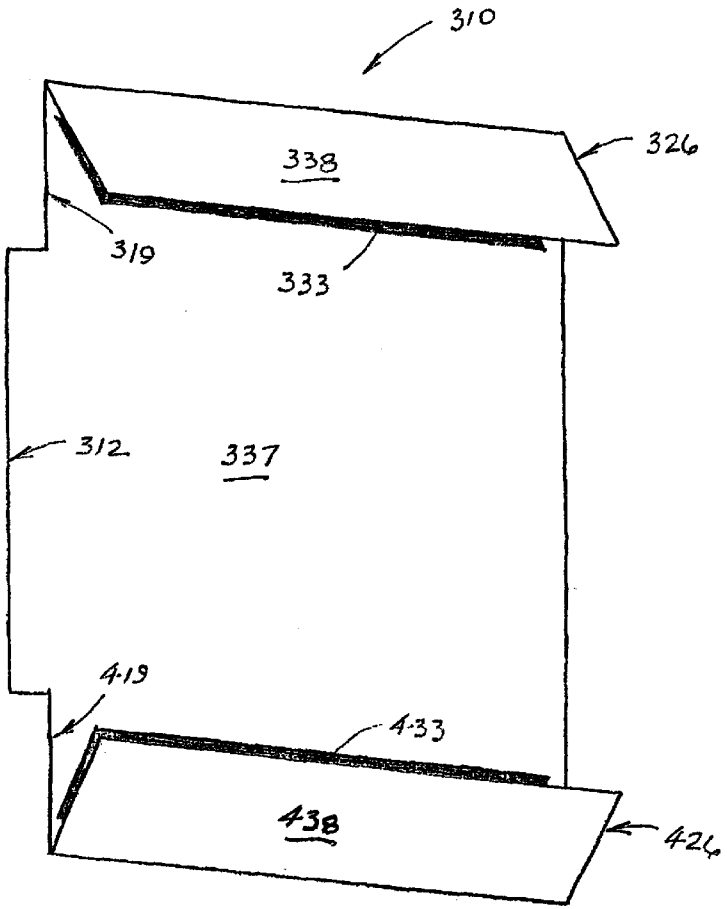
FIG. 7 is a perspective view of the advertising page of FIG. 6, when provided with two sample materials and folded according to a third embodiment of the invention.

Two other embodiments of the invention are illustrated by FIGS. 6-8. As shown in FIG. 6, advertising page 310 includes generally rectangular page portion 316, which has binding side 312, a top unbound side defined by line 320, outer unbound side 322 and a bottom unbound side defined by line 420. Both the top unbound side and the bottom unbound side of page portion 316 are adjacent to binding side 312, which is adapted to be bound with or into the pages of a publication (not shown). Page 310 also includes first extension portion 318 and second extension portion 418. First extension portion 318 is contiguous with a part of the top unbound side of the page portion and has inner side 319 that is spaced from (or offset from) binding side 312 of the page portion. The first extension portion also includes first part 321 and second part 323 which are divided by line 325 into parts of generally equal size, although the line of division between the first part and the second part may be placed at any convenient location. First part 321 is folded over second part 323 to form a folded part 326, as shown in FIGS. 7 and 8. In the alternative, at least a part of first extension portion 318 may be folded over along line 320 or along any line located between line 320 and top side 327. If a part of first extension portion 318 is folded over along line 320 or along any line located between line 320 and line 325, the folded part will overlap a part of page portion 316.

Second extension portion 418 is contiguous with a part of the bottom unbound side of the page portion and has inner side 419 that is spaced from (or offset from) binding side 412 of the page portion. The second extension portion also includes first part 421 and second part 423 which are divided by line 425 into parts of generally equal size, although the line of division between the first part and the second part may be placed at any convenient location. First part 421 is folded over second part 423 to form a folded part 426, as shown in FIG. 7. In the alternative, at least a part of first extension portion 418 may be folded over along line 420 or along any line located between line 420 and bottom side 427. If a part of second extension portion 418 is folded over along line 420 or along any line located between line 420 and line 425, the folded part will overlap a part of page portion 316.

Surface 329 of first part 321 and/or surface 331 of second part 323 of first extension portion 318 may be printed with a coupon, information card or other advertisement. Likewise, surface 429 of first part 421 and/or surface 431 of second part 423 of second extension portion 418 may be printed with a coupon, information card or other advertisement. Lines between the first and second parts and between the second part and the page portion may also be perforated to permit removal of such coupons or information cards. The surface of folded part 326, comprised of surfaces 329 and 331, and/or the surface of folded part 426, comprised of surfaces 429 and 431 (in the embodiment of FIG. 7), may be printed with an advertisement that continues onto surface 337 of page portion 316. In addition (or in the alternative), surface 338 of folded part 326 and/or surface 438 of folded part 426 (in the embodiment of FIG. 7) may be printed with an advertisement that continues onto surface 337 of page portion 316.

A sample material may also be applied to either or both of surfaces 329 and 331 or contained between such surfaces. FIG. 7 illustrates an embodiment of the invention in which sample material 333 is applied to surface 329 of first part 321, whereas FIG. 8 illustrates an embodiment in which sample material 633 is applied to surface 331 of second part 323. Preferably, the folded part will be attached to surface 331 of the extension portion by a releaseable adhesive that surrounds or is contained within sample 333. It is also contemplated that the extension portion may be folded over, and attached to, a portion of the page portion. Similarly, a sample of the same or a different material than sample 333 may be applied to either or both of surfaces 429 and 431 or contained between such surfaces. FIG. 7 illustrates an embodiment of the invention in which sample material 433 is applied to surface 429 of first part 421. FIG. 8 illustrates an embodiment of the invention in which first part 421 of second extension portion 418 is folded towards the surface of page portion 316 opposite surface 337.

Therefore, as shown in FIG. 8, sample material 533 is applied to the surface 531 of second part 423 that is opposite surface 431.

According to a preferred embodiment of the invention, the advertising page may be provided in the form of page 310 shown in FIG. 6. In such event, the page may be folded as described herein to further prepare the advertising page for binding in a publication. In the alternative, however, the advertising page may be provided in the form of a generally rectangular sheet having a binding side, and two portions of the sheet may be folded along folds that are generally perpendicular to the binding side to form a pair of folded parts, each having an area less than one half of the area of the rectangular sheet. Then a notch may be cut along a side of each folded part adjacent to the binding side of the sheet and sample material added (if desired) to create an advertising page such as is shown in either FIG. 7 or FIG. 8. The invention may also be practiced by first applying one or more sample materials to a portion of the rectangular sheet, and then folding the sheet along a pair of folds, each of which is generally perpendicular to the binding side, to form a pair of folded parts each of which includes a sample material and has an area less than one half of the area of the rectangular sheet. Finally, a pair of notches may be cut along a side of each folded part adjacent to the binding side of the sheet to create an advertising page such as is shown in either FIG. 7 or FIG. 8.

The invention provides for significant savings in production costs for an advertising page. The width of a sheet that is used in preparing an advertising page according to the invention, as measured across the page from the binding side, can be the same width as that of the other sheets intended to be bound in the publication. Furthermore, since the width of a page is usually less than its length, as measured along the binding side, the area of a sheet that is to include a folded part of a given fold size according to the invention (as such fold size is measured, for example, across folded part 126 of page 110 in a direction parallel to binding side 112, as shown in FIG. 4) will be less than the area of a conventional sheet that is to include a folded part of the same fold size (as measured across folded part 26 of page 10 in a direction perpendicular to binding side 12, as shown in FIG. 1).

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. An advertising page which is adapted to be bound within a publication comprised of a plurality of pages bound together along a binding side, which advertising page comprises:

(A) a page portion having:
  (i) a binding side; and
  (ii) a plurality of unbound sides; and (B) an extension portion:
  (i) which is contiguous with a part of an unbound side of the page portion that is adjacent to the binding side; and
  (ii) which has an inner side that is spaced from the binding side of the page portion;
  wherein at least a part of the extension portion is folded over to form a folded part.

2. The advertising page of claim 1 wherein the extension portion has a first part and a second part, and the first part is folded over the second part to form the folded part.

3. The advertising page of claim 1 wherein at least a part of the extension portion is folded over at least a part of the page portion to form the folded part.

4. The advertising page of claim 1 wherein the page portion is generally rectangular and has a binding side, a top unbound side, an outer unbound side and a bottom unbound side.

5. The advertising page of claim 4 which includes a first extension portion that is contiguous with a part of the top unbound side of the page portion and a second extension portion that is contiguous with a part of the bottom unbound side of the page portion, and wherein at least a part of the first extension portion is folded over to form a first folded part, and wherein at least a part of the second extension portion is folded over to form a second folded part.

6. The advertising page of claim 5 wherein the page portion has a first surface and a second surface, and wherein the first folded part is attached to the first surface of the page portion and the second folded part is attached to the second surface of the page portion.

7. The advertising page of claim 1 wherein the folded part of the extension portion has an inner surface and an outer surface, and wherein an advertisement is printed on the outer surface of the folded part of the extension portion and the page portion.

8. The advertising page of claim 1 wherein the folded part of the extension portion has an inner surface and an outer surface, and wherein an advertisement is printed on the inner surface of the folded part of the extension portion.

9. The advertising page of claim 1 which includes a sample material that is contained within the folded part, which folded part is attached to a part of the extension portion or to the page portion.

10. The advertising page of claim 1 wherein a part of the extension portion is perforated and folded to form a plurality of folded parts, each of which includes a sample material.

11. A method for making an advertising page to be bound within a publication comprised of a plurality of pages bound together along a binding side, which method comprises:

(A) providing a generally rectangular sheet having a binding side;

(B) folding a portion of the sheet along a fold that is generally perpendicular to the binding side to form a folded part having an area that is less than one half the area of the rectangular sheet;

(C) cutting a notch along the side of the folded part adjacent to the binding side of the sheet.

12. The method of claim 11 which includes perforating the portion of the sheet that is folded along the fold so as to form a plurality of folded parts.

13. The method of claim 11 which includes depositing sample material on a portion of the generally rectangular sheet away from the binding side of the sheet, said portion being selected so as to be covered by the folded part.

14. The method of claim 13 which includes applying an adhesive within the folded part.

15. A method for making an advertising page to be bound within a publication comprised of a plurality of pages bound together along a binding side, which method comprises:

(A) providing a sheet comprising:

(i) a page portion having:

(a) a binding side;

(b) a plurality of unbound sides;

(c) an inner surface;

(ii) an extension portion which:

(a) is contiguous with a part of an unbound side of the page portion that is adjacent to the binding side;

(b) has an inner surface;

(c) has an inner side that is offset from the binding side of the page portion;

(B) depositing sample material onto the inner surface of the extension portion;

(C) folding at least a part of the extension portion over to form a folded part over the sample material;

(D) attaching the folded part to the extension portion or to the page portion to contain the sample material therebetween.

16. The method of claim 15 which includes:

(E) providing a sheet including an extension portion having an inner surface and an outer surface which is opposite the inner surface;

(F) printing an advertisement on the outer surface of the folded part of the extension portion and the page portion.

17. The method of claim 15 which includes:

(E) providing a sheet including:

(i) a generally rectangular page portion having a binding side, an upper unbound side, an outer unbound side, a lower unbound side and at least one inner surface;

(ii) a first extension portion that is contiguous with a part of the upper unbound side of the page portion, which first extension portion includes a first part having a first inner surface and a second part having a second inner surface;

(iii) a second extension portion that is contiguous with a part of the lower unbound side of the page portion, which second extension portion includes a first part having a first inner surface and a second part having a second inner surface;

(F) depositing a first sample material onto the first inner surface of the first extension portion and/or onto the second inner surface of the first extension portion;

(G) depositing a second sample material onto the first inner surface of the second extension portion and/or onto the second inner surface of the second extension portion;

(H) folding the first part of the first extension portion over the second part to form a first folded part;

(I) folding the first part of the second extension portion over the second part to form a second folded part;

(J) attaching the first part of the first extension portion to the second part to contain the first sample material therebetween;

(K) attaching the first part of the second extension portion to the second part to contain the second sample material therebetween.

18. The method of claim 17 which includes providing a sheet including a page portion having a first inner surface and a second inner surface, which surfaces are located on opposite sides of the sheet.

* * * * *